US005509141A

United States Patent [19]

Saltzman

[11] Patent Number: 5,509,141

[45] Date of Patent: Apr. 23, 1996

[54] INSULATED BIB APPARATUS

[75] Inventor: Lita Saltzman, Denver, Colo.

[73] Assignee: Baby Biz Products, Inc., Denver, Colo.

[21] Appl. No.: 335,126

[22] Filed: Nov. 7, 1994

[51] Int. Cl.[6] ..... A41B 13/10; A41D 11/00

[52] U.S. Cl. ..... 2/49.2; 2/49.4; 2/49.1

[58] Field of Search ..... 2/69, 69.5, 46, 2/48, 49.1, 49.2, 49.3, 49.4, 49.5, 75, 80, 105, 106, 114, 104, 113, 115, 88, 50, 51, 52

[56] References Cited

U.S. PATENT DOCUMENTS

| | | | |
|---|---|---|---|
| 593,618 | 11/1897 | Stackhouse | 2/49.5 |
| 1,067,761 | 7/1913 | Schulz | 2/46 |
| 2,451,718 | 10/1948 | Corrao | 248/105 |
| 2,482,182 | 9/1949 | Henninger | 2/48 |
| 2,631,288 | 3/1953 | Daust | 2/49 |
| 4,564,957 | 1/1986 | Scharf | 2/75 |
| 4,575,876 | 3/1986 | Weaver | 2/69.5 |
| 4,663,779 | 5/1987 | Bible | 2/49 X |
| 4,779,288 | 10/1988 | Mack | 2/49 R |
| 4,793,004 | 12/1988 | Long et al. | 2/49 R |
| 4,811,428 | 3/1989 | Waldman et al. | 2/49 R |
| 4,860,381 | 8/1989 | Bartley | 2/49 A |
| 4,873,725 | 10/1989 | Mitchell | 2/48 |
| 5,033,135 | 7/1991 | Creek | 2/69.5 |
| 5,312,282 | 5/1994 | Cooper | 446/27 |
| 5,459,877 | 10/1995 | Roberti | 2/104 |

FOREIGN PATENT DOCUMENTS

| | | | |
|---|---|---|---|
| 2323340 | 12/1990 | United Kingdom | 2/48 |

*Primary Examiner*—Jeanette E. Chapman
*Attorney, Agent, or Firm*—Pravel, Hewitt, Kimball & Krieger

[57] ABSTRACT

A baby bib apparatus includes a bib member that has front and rear panels with respective front and rear surfaces that are preferably water resistant or water repellant. A layer of insulating material (e.g. cotton or foam) is sandwiched between the front and rear panels forming a lamination therewith. A peripheral seal in the form of a welt extends around the periphery of the front and rear panels and layer of foam. A circular recess or opening at the upper end of the bib defines a fitment for securing the bib about an infants neck. A transverse pocket extends across the bottom of the bib having an open top for allowing articles to be placed in the pocket. A pocket welt extends about the periphery of the pocket sealing the pocket to the bottom and sides of the bib member. The lamination is sized sufficiently from the top to the bottom so that articles fitted inside the pocket can be enveloped by the front panel rolling about the contained articles in pocket. A closure is provided for securing the top end of the bib in the rolled position so that an article contained within the pocket can be insulated with the foam and panels forming the lamination.

14 Claims, 1 Drawing Sheet

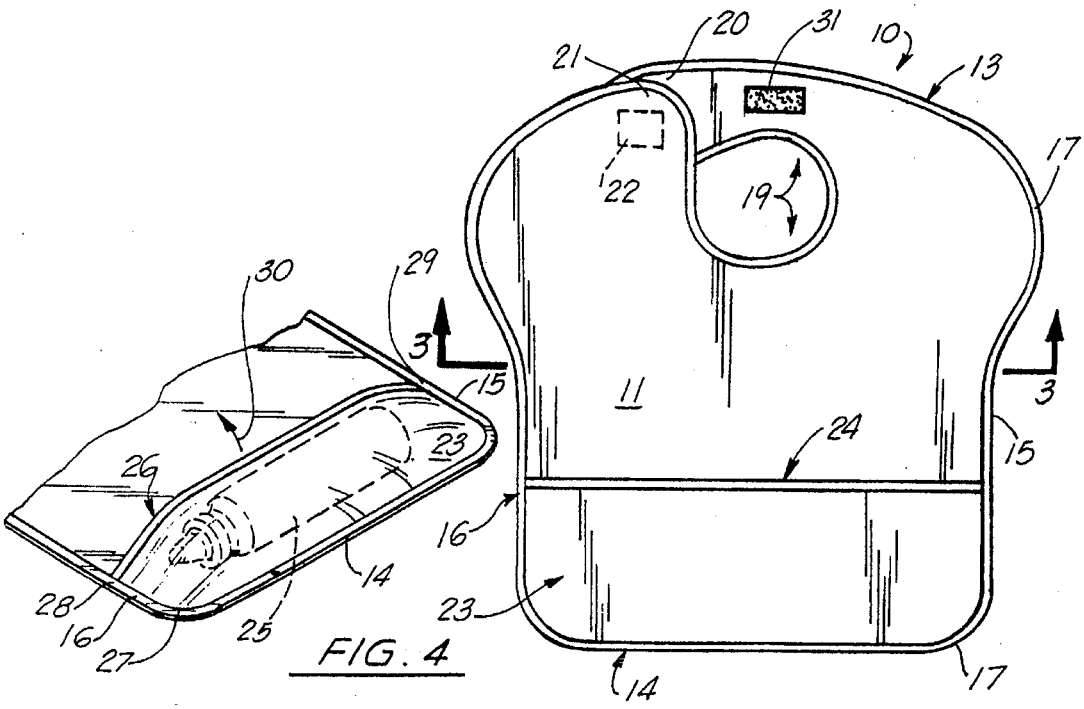
FIG. 1
FIG. 4
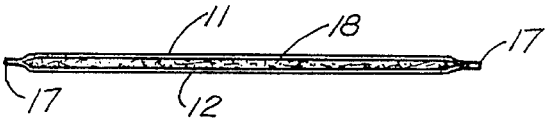
FIG. 3
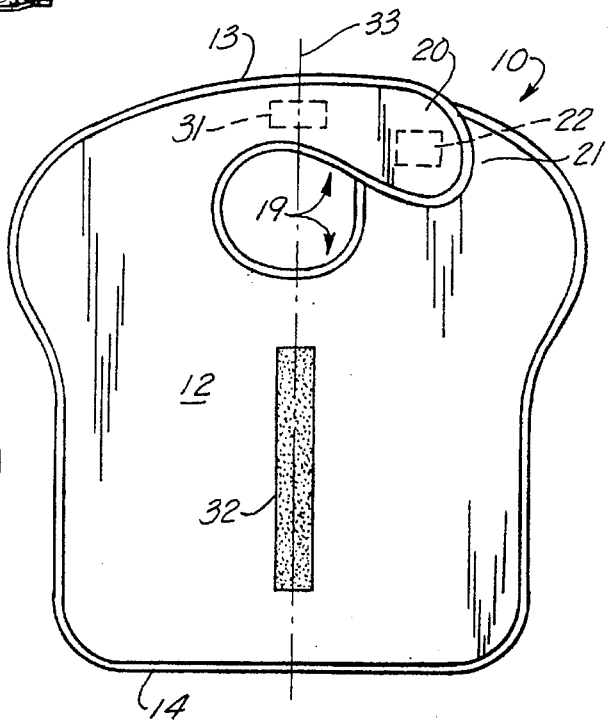
FIG. 2
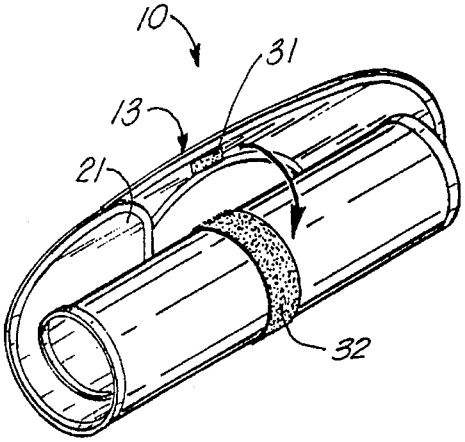
FIG. 5

INSULATED BIB APPARATUS

SPECIFICATION

1. Field of the Invention

The present invention relates to bibs, especially infant bibs and more particularly to an improved infant bib that provides a transverse pocket for holding articles that are to be maintained in either warm or cool conditions, the pocket and its contained articles being encircled by a bib panel in a "rolled" position which can be secured using a closure. The apparatus can be used to hold articles that are to be maintained warm such as an infant bottle, jars of baby food, or food articles such as hot dogs, or the like. The article can also be used to contain articles of food that are to be maintained cold such as fruit juices and the like.

2. General Background

Infant bibs are commonly used to protect the upper torso of babies and small infants when they are still perfecting the the art of eating solid foods. It is known in the art to provide a transverse pocket at the bottom of such bibs for catching food articles that are dropped by the infant.

When mothers are traveling with their infants, one of the problems is the maintaining of food articles in either hot or cold conditions. Infant formula, milk, and liquids contained in a bottle are typically maintained in a warm condition. This is also true of many baby foods that are commercially available in small cylindrically shaped jars. Sometimes, several of these jars must necessarily be maintained in a warm condition before it is time to feed the infant. Small toddlers can eat food that is solid such as hot dogs for example. These solid food items are desirably maintained in a warm condition.

Many food articles that an infant will consume during a morning are best maintained in a cold condition such as juice and the like. Such food items can include fruit juice, chocolate milk, and the like.

Many bib devices have been patented which relate to the problem of containing food articles that are dropped by the infant. Other devices describe various bib constructions that hold bottles, some having insulating features.

U.S. Pat. No. 2,451,718 relates to a holder for baby bottles. It has particular application to baby bottle holders which will keep a baby's nursing bottle in suitable angular relation for nursing and which may conveniently be placed in position where a baby can benefit from it no matter what its position in the crib.

U.S. Pat. No. 2,631,288 discloses a bib and bottle holding device. An object of the '288 patent resides in the provision of a bottle holder which supports the bottle and couples the same to the infant, such that the bottle is held and the nipple presented in a readily accessible position to the mouth, even though the child shifts or turns considerably during the feeding.

U.S. Pat. No. 4,779,288 entitled "Reusable Bib Having Material-Receiving Pocket" disclosed a disposable bib having a collection pocket, which is maintained in an opened position. The bib includes a base sheet of fluid impervious material and a top sheet of non-woven hydrophobic material. A pocket formed of the same material is formed by securing a section to the rear surface of the base sheet along at least the side edges with the section being secured to the base sheet along a location extending from the side edges of the sheet to a line at least three eighths of an inch inwardly thereof.

U.S. Pat. No. 4,663,779 entitled "Protective Covering or Bib" discloses a bib that is described for infant or adult use comprising a backing sheet of clear glazed plastic having a breast panel, shoulder panels on either side of the neck opening and a clear pocket panel secured along an arcuate lower edge to the back panel. The rear terminal edge portions of the neck opening are spaced apart so that when they are drawn together around the neck of the user, the shoulder panels curve smoothly over the shoulders and the breast panels curve smoothly around the body of the user. The upper edge of the pocket is at least about 5% longer than the corresponding dimension of the back panel so that as the back panel curves around the body, the pocket stands in an open position. This is assisted by forming the front panel from a stiffer material than the back panel.

U.S. Pat. No. 4,793,004 entitled "Disposable Bib Construction" discloses a disposable bib. The bib is constructed of a unitary sheet of drapable material. The unitary sheet has opposite top and bottom edges defining a length direction therebetween, and opposite side edges defining a width direction therebetween. A pair of slots extend along opposite side edges of the sheet. The slots define a pair of ties along respective opposite side edges of the sheet for use in securing the bib to a wearer by being tied about the neck.

U.S. Pat. No. 4,811,428 entitled "Washable and Disposable Bib and Fabric for Manufacturing Same" discloses a bib for children is fabricated of a thermally bonded laminate of vinyl film and polyester fabric materials. The laminate is provided with an embossed finish which is abrasion resistant and washable. A water based, non-leaching acrylic ink is applied to the embossed finish for ornamentation. The bib includes a body portion having interior vinyl and outer polyester sides, top and bottom peripheral edges, and side edges. First and second neck fastening members extend from the top peripheral edge and terminate at overlapping ends which include synthetic hook and loop fastener elements. The bib also includes a pocket formed by a panel which overlies and is thermally sealed to the body portion. A durable pocket construction is provided by employing reinforcing thermal seals to secure the pocket panel to the body portion.

U.S. Pat. No. 4,860,381 entitled "Bib-Bowl" discloses a bib-bowl for use during feeding of a user comprises a bowl to carry food to be eaten by the user having a rim, a bottom, and a given portion adjacent the body of the user containing therein a circular slot having a predetermined length; and a sheet of material having fastening means to secure the material about the neck of the user and a given width adjacent the bowl, the material being threaded through the slot from the inside of the bowl to the outside thereof, the predetermined length and the given width having a predetermined relative value to cause the material to assume a concave channel configuration extending from the neck of the user to the bowl to enhance the return of food and liquid to the bowl when spilled.

U.S. Pat. No. 5,312,282 entitled "Baby Bottle and Bib Structure" discloses a baby bottle structure forming a doll. The baby bottle comprises a central fluid receptacle having a nipple portion at one end and a bottom portion at the opposing end. A removable cover is snapped about the nipple portion and forms the head of a doll. A removable bottom portion is attachable to the central fluid receptacle of the bottle and creates the feet portion of the doll. The feet of the doll are formed in such a way as to support the bottle in an upright position. The removable bottom support structure houses a music module that may be activated by tilting the baby bottle. The bottom portion also provides a housing for enclosing an independent pacifier. Thus, the baby bottle forms a musical doll and provides means for carrying a pacifier within its body structure. A bib is provided with the baby bottle and supports the baby bottle about the neck of an infant. A rattle or rattles may be removably attachable to the bib and form arms of the doll.

Some of these patented devices relate to bibs with pockets for catching dropped food. Others relate to bibs with insulating panels to warm the baby's bottle. However, bibs that insulate the baby's bottle typically orient the bottle vertically to present the nipple to the baby's mouth.

Thus, there is a need for an improved bib apparatus that solves the problem of catching dropped or spilled food, insulating any item whether single bottle, multiple jars, or a solid item (e.g. hot dog) and storing very compactly to a cylinder shape when functioning as an insulator.

SUMMARY OF THE INVENTION

The present invention solves prior art food storage and food spillage problems and short comings by providing a bib apparatus that form both functions of food spillage (i.e. protection of clothing) and temperature control, (maintain articles in either cool or warm condition).

These objects are accomplished by providing a bib apparatus that includes a pocket for holding articles such as bottles, jars of baby food, hot dogs and the like. The bib apparatus of the present invention thus includes a bib member having front and rear panels with respective front and rear surfaces, each preferably of a plastic or polymer construction that is water proof or water resistant.

A layer of insulating material (e.g. foam) is sandwiched between the front and rear panels forming a lamination therewith.

A peripheral seal such as a welt or heat seal is provided for sealing the lamination of the front and rear panels and the layer of foam at least at the periphery of the bib member.

A recess is provided at the upper end of the bib for fitment about the infants neck.

A closure allows the bib to be attached to the infants frontal torso, preferably in the form of a clasp at the recess after the bib has been fitted about the infants neck.

A pocket extends transversely from one side of the bib to the other and in communication with the bottom of the bib. The pocket provides an open top that extends preferably fully across the bib front panel between the sides thereof. The pocket catches dropped food stuffs and stores bottles or containers or food items to be insulated (e.g. maintained cool or warm).

A pocket welt or like closure peripherally seals the pocket to the bottom and to the sides of the bib member for a short distance that defines the vertical dimension of the pocket.

The lamination is sufficiently sized from top to bottom so that articles fitting inside the pocket can be enveloped by the front panel by simply rolling the front panel about the contained articles.

The top edge of the pocket defines a transverse axis that is parallel to the central longitudinal axis of cylindrically shaped articles that are placed within the pocket for example. The pocket is about one third the vertical dimension of the bib's vertical dimension. As an example, the pocket is 3½ inches vertical dimension and the bib overall is 12 inches in vertical dimension, with a width (transverse dimension) of 10–11 inches.

When the user simply rotates the entire bib apparatus about the enclosed article and pocket, the lamination of the front and rear panel and foam encapsulate the articles forming an installation. In this "rolled" position, the apparatus can be sealed with a closure that holds the peripheral edge of the top of the bib member against the remainder of the bib member, holding the apparatus in a cylindrical configuration which insulates the contained articles placed in the pocket.

BRIEF DESCRIPTION OF THE DRAWINGS:

For a further understanding of the nature and objects of the present invention, reference should be had to the following detailed description, taken in conjunction with the accompanying drawings, in which like parts are given like reference numerals, and wherein:

FIG. 1 is a frontal elevation view of the preferred embodiment of the apparatus of the present invention;

FIG. 2 is a rear view of the preferred embodiment of the apparatus of the present invention;

FIG. 3 is a sectional view taken along lines 3—3 of FIG. 1;

FIG. 4 is a partial perspective view of the preferred embodiment of the apparatus of the present invention; and FIG. 5 is a perspective view of the preferred embodiment of the apparatus of the present invention illustrating the "rolled" configuration.

DETAILED DESCRIPTION OF THE PREFERRED EMBODIMENT:

FIGS. 1 and 2 show generally the of the preferred embodiment of the apparatus of the present invention designated generally by the numeral 10. Bib apparatus 10 includes a bib member having front 11 and rear 12 panels each defining respective front and rear surfaces of the bib apparatus 10. The bib 10 also includes upper 13 and lower 14 edges as well as side edges 15, 16. A peripheral welt 17 extends about bib apparatus 10, forming a seal to the lamination that is defined by front panel 11, rear panel 12, and insulating foam layer 18 (see FIG. 3). The peripheral welt 17 can be a stitched welt, or can be simply a heat sealed periphery that forms a seal as shown in FIG. 3 of the panels 11, 12 and foam layer 18.

A recess 19 is provided for fitting the bib apparatus 10 to an infants neck. The bib 10 includes a pair of flaps 20, 21 that can be affixed together using a Velcro closure, snaps, or the like as a closure. A Velcro closure 22 is shown in phantom lines in FIGS. 1 and 2. Such Velcro closures 22 are commercially available. The Velcro closure 22 can be sized and shaped to provide an adjustable closure for sizing the bib to fit infants of different sizes.

A pocket 23 extends transversely across the lower end of bib apparatus 10, between sides 15, 16 and communicating with bottom 14. Pocket 23 provides an upper edge 24 that is open between sides 15, 16 so that articles such as bottle 25 can be added to the interior 26 of pocket 23. A pocket welt 27 extends from position 28 in FIG. 4 to position 29 in FIG. 4 thus sealing the pocket 23 to the sides 16, 17 of bib 10 and to the bottom 14 thereof.

In order to insulate a bottle or like article 25, the user simply puts the article 25 within pocket 23 and then rolls the pocket 23 and its contained article 25 in the direction of arrow 30 in FIG. 4. This causes the pocket to be encapsulated by the front panel 11 and pocket 23 of bib 10. When fully encapsulated in a "rolled" position, Velcro fastener 31 on front panel 11 (see FIG. 1) comes into contact with an elongated Velcro strip 32 on rear panel 12 (see FIG. 2). The strip 32 is elongated so that the fastener 31 will contact the strip 32 not withstanding the variation in diameter of articles 25 that might be placed within the pocket 23.

In the preferred embodiment, the vertical fastener strip falls along a line 33 that is the vertical axis of bib 10, generally perpendicular to bottom edge 14 of bib 10 as shown in FIG. 2. In FIG. 5, the "rolled" position of the bib apparatus 10 is illustrated. Fastener 31 is being rolled toward the strip 32 placing the bib apparatus in a generally cylindrical rolled-up position. The bottom edge 14 has been rolled with pocket 23 and contained article 25 upon front panel 11 and toward top edge 13.

In FIG. 5, the fastener 31 is simply attached to the strip 32 for securing the apparatus 10 in a cylindrical position about the contained article or articles 25.

The following table lists the parts numbers and parts descriptions as used herein and in the drawings attached hereto.

PARTS LIST

| Part Number | Description |
|---|---|
| 10 | insulated bib apparatus |
| 11 | front panel |
| 12 | rear panel |
| 13 | upper edge |
| 14 | lower edge |
| 15 | side edge |
| 16 | side edge |
| 17 | welt |
| 18 | insulating layer |
| 19 | recess |
| 20 | flap |
| 21 | flap |
| 22 | closure |
| 23 | pocket |
| 24 | upper edge |
| 25 | bottle |
| 26 | interior |
| 27 | welt |
| 28 | position |
| 29 | position |
| 30 | arrow |
| 31 | fastener |
| 32 | fastener strip |
| 33 | vertical axis |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A baby bib apparatus for holding an article to be maintained at a desired temperature range such as warm or cold comprising:

a) a bib member having front and rear panels with respective front and rear surfaces, a top portion, a bottom portion, and side edge portions;

b) a layer of foam insulation sandwiched between the front and rear panels forming a lamination therewith;

c) a peripheral welt for sealing the lamination of the front and rear panels and layer of foam;

d) a recess at the upper end of the bib for fitment about an infant's neck;

e) means positioned adjacent the recess for supporting the bib on the infant's frontal torso;

f) a pocket that provides a void space extending transversely from one side edge portion of the bib member to the other side edge portion and being adjacent the bottom portion of the bib member, the pocket having an open top that extends transversely across the bib front panel so that the article to be maintained at a desired temperature can be placed in the pocket via the open top;

g) a pocket welt for peripherally sealing the pocket to the bottom portion and to the side portions of the bib member;

h) the lamination being sufficiently sized from top to bottom so that an article fitting inside the pocket can be enveloped by the front panel by rolling the front panel about the contained articles and pocket; and i) a pair of cooperating closure members for holding the peripheral edge of the bib member adjacent the neck opening against the bib member after the front panel is rolled tightly about the pocket and contained articles for closely conforming the bib to the article to surround and insulate same;

j) said pair of members being on opposite sides of the bib, one of the closure members being positioned at the neck of the bib.

2. The bib apparatus of claim 1 wherein the laminate includes at least one layer of plastic foam material.

3. The bib apparatus of claim 1 wherein the closure means comprises an first connecting member that forms an elongated strip of connecting material that can form a connection with a second connecting member positioned at the upper end of the bib member.

4. The bib apparatus of claim 3 wherein the bib member has a vertical axis and the first connection member extends along the bib vertical axis.

5. The bib apparatus of claim 3 wherein the first connecting member is affixed to the rear panel rear surface.

6. The bib apparatus of claim 3 wherein the second connecting member is affixed to the front panel front surface.

7. The bib apparatus of claim 1 wherein the pocket has an open side that extends completely across the bib member.

8. The bib apparatus of claim 1 wherein the pocket has a vertical dimension that is about one third of the vertical dimension of the bib member.

9. The bib apparatus of claim 1 wherein the pocket has a vertical dimension that is less than one third of the vertical dimension of the bib member.

10. The bib apparatus of claim 1 wherein the opening is generally circular.

11. The bib apparatus of claim 10 wherein the opening is spaced below the bib upper edge.

12. A baby bib apparatus for holding an article to be maintained at a desired temperature range, such as warm or cold, comprising:

a) a flexible bib member comprised of a plurality of layered panels, the bib member having front and rear surfaces, a top portion, a bottom portion, and side edge portions;

b) the plurality of layered panels including a layer of insulation;

c) a securing portion at the upper end of the bib that is shaped for fitment about an infant's neck;

d) the securing portion including a closure for securing the bib on the infant's frontal torso and to the infant's neck;

e) a pocket that provides a void space extending transversely from one side edge portion of the bib member to the other side edge portion and being adjacent the bottom portion of the bib member, the pocket having an open top that extends transversely across the bib front panel so that the article to be maintained at a desired temperature can be placed in the pocket via the open top;

f) the pocket void space having a transverse width extending from one side portion of the bib to the other side portion of the bib;

g) the pocket void space having a vertical height extending from the bottom portion of the bib to the pocket open top, said void space having a much greater transverse width than vertical height;

h) the bib member being sized and shaped so that an article fitting inside the pocket void space can be enveloped by the bib member by rolling the bib member about the contained article and pocket; and i) a pair of cooperating closure members for holding the bib member in the closed position that closely conforms the bib member to the article to surround and insulate same;

j) said pair of members being on opposite sides of the bib, one of the closure members being positioned at the neck of the bib.

13. A baby bib apparatus for holding an article to be maintained at a desired temperature range, such as warm or cold, comprising:

a) a flexible bib member comprised of a plurality of layered panels, the bib member having front and rear surfaces, a top portion, a bottom portion, and side edge portions;

b) the plurality of layered panels including a layer of insulation;

c) a securing portion at the upper end of the bib that is shaped for fitment about an infant's neck;

d) the securing portion including a closure for securing the bib on the infant's frontal torso and to the infant's neck;

e) an elongated article to be temperature controlled, said article having a central longitudinal axis, a length measured along said longitudinal axis, and a diameter, said length being much greater than said diameter;

f) a pocket that provides a void space extending transversely from one side edge portion of the bib member to the other side edge portion and being adjacent the bottom portion of the bib member, the pocket having an open top that extends transversely across the bib front panel so that the elongated article can be placed in the pocket via the open top, wherein the central longitudinal axis of the article is oriented transversely, generally parallel with the open top;

g) the pocket void space having a transverse width extending from one side portion of the bib to the other side portion of the bib;

h) the pocket void space having a vertical height extending generally from the bottom portion of the bib to the pocket open top, said void space having a much greater transverse width than vertical height, and greater than the length of said elongated article;

i) the bib member being sized and shaped so that an article fitting inside the pocket void space can be enveloped by the bib member by rolling the bib member about the contained article and pocket; and j) a pair of cooperating closure members for holding the bib member in the closed position that closely conforms the bib member to the article to surround and insulate same;

k) said pair of closure members being on opposite sides of the bib, one closure members being positioned at the neck of the bib.

14. The bib apparatus of claim 13 wherein the article is a generally tubular shaped container.

* * * * *